US007020387B1

(12) United States Patent
Andrakin

(10) Patent No.: US 7,020,387 B1
(45) Date of Patent: Mar. 28, 2006

(54) HYBRID WATER HEATER

(76) Inventor: James W. Andrakin, 40500 Wilderness Lodge Rd., Branscomb, CA (US) 95417

( * ) Notice: Subject to any disclaimer, the term of this patent is extended or adjusted under 35 U.S.C. 154(b) by 0 days.

(21) Appl. No.: 11/091,465

(22) Filed: Mar. 28, 2005

(51) Int. Cl.
*F24H 1/10* (2006.01)

(52) U.S. Cl. ..... 392/465; 392/466; 429/12

(58) Field of Classification Search ..... None
See application file for complete search history.

(56) References Cited

U.S. PATENT DOCUMENTS 5,216,743 A * 6/1993 Seitz ..... 392/490
6,418,275 B1 * 7/2002 Yang ..... 392/441
6,465,118 B1 * 10/2002 Dickman et al. ..... 429/20

* cited by examiner

*Primary Examiner*—Thor S. Campbell
(74) *Attorney, Agent, or Firm*—Hall, Vande Sande & Pequignot

(57) ABSTRACT

A tankless water heater powered by a fuel cell. In preferred embodiments, a fuel cell powered water heater in which the fuel cell is electrically connected to the electrical system of the building in which the water heater is installed as well as to the public electrical power grid for providing emergency power to the building and/or power to the public electrical power grid, respectively. In alternative preferred embodiments, a tankless, solid oxide fuel cell powered water heater which utilizes heat from exhaust gases to heat input oxidant gases and, optionally, can be cooled by routing excess heat to the exterior of the building on hot days.

24 Claims, 4 Drawing Sheets

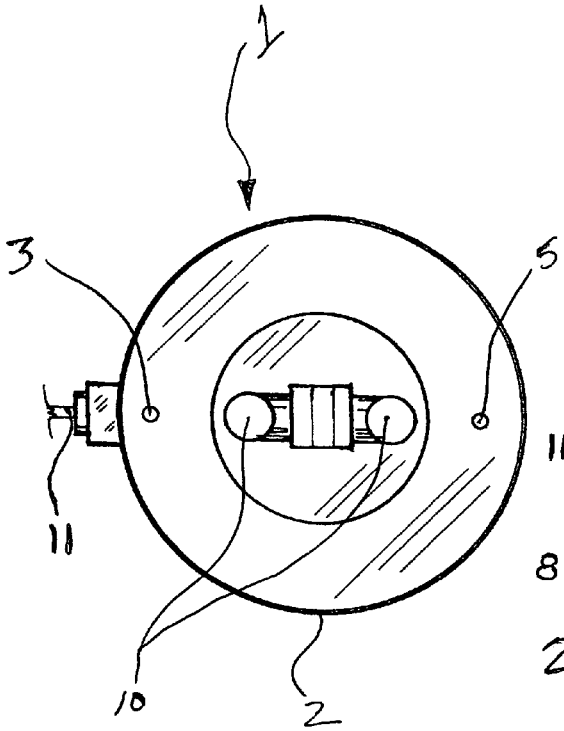
FIG. 8
FIG. 7
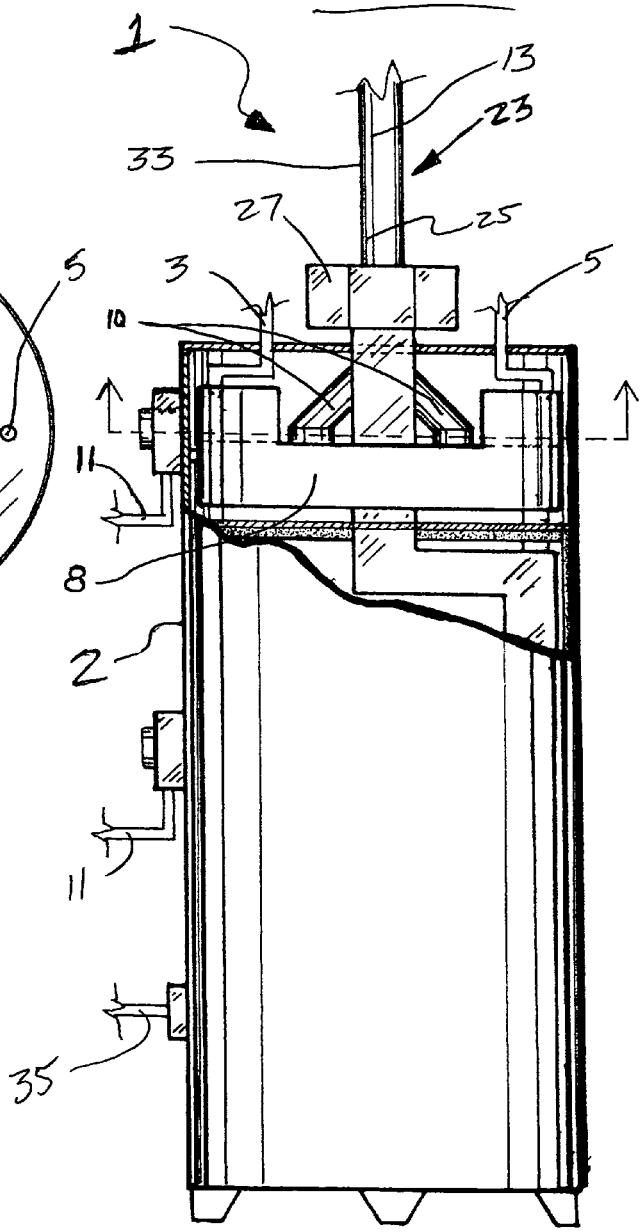

HYBRID WATER HEATER

FIELD OF INVENTION

This invention relates to a water heater powered by a fuel cell. In preferred embodiments, this invention relates to a fuel cell powered water heater in which the fuel cell is electrically connected to the electrical system of a building as well as to the public electrical power grid. In alternative preferred embodiments, this invention relates to a tankless, solid oxide fuel cell powered water heater which utilizes heat from exhaust gases to heat input oxidant gases and which, optionally, can act as an electrolyzer.

BACKGROUND OF THE INVENTION

As is generally known in the industry, the operational costs of conventional water heaters account for approximately ten-percent to twenty-percent or more of an average household's annual energy expenditures. In this regard, the cost to operate a conventional gas or electric water heater (i.e., a storage tank-type) in a typical household averages between $300 and $600 annually, respectively (although the costs can be much more in larger homes and commercial buildings).

Although a variety of water heater types are known and used throughout the world, in the United States, acceptance of water heater types, other than storage tank-types, has not been widespread. Thus, the vast majority of water heaters used in the United States are of the storage tank variety.

A conventional storage tank-water heater includes a water storage reservoir in which water is heated and then stored for use by the household. In such a water heater, there is cold water inlet at the bottom of the storage tank and a hot water outlet located at the top of the storage tank. In a gas fueled storage tank-type water heater, in order to heat the water within the storage tank, a burner is provided which normally burns natural or propane gas. Conversely, in a typical electrically powered storage tank-type water heater, electric current is passed through upper and lower electrical heating elements each of which are controlled individually by temperature sensors that, for example, are set to high, medium, or low settings as desired.

As a design feature of conventional water heaters, in order for the water heater to function properly, the water in the storage tank must be periodically heated to maintain the water temperature at the temperature selected for output for household usage (even when no hot water is being used by the household). If the water in the tank is not periodically heated, the water will eventually cool to the ambient temperature due to various standby losses, e.g., heat conducted and radiated through the walls of the tank and/or heat lost through the flue pipe. Moreover, if there is not a pilot-less ignition system, a pilot light must be constantly maintained so that the burners can be fired up when needed such as, for example, when cold water enters the storage tank as hot water is being used by the household. As standby losses represent approximately 10% to 20% of a household's annual water heating costs, it can be seen that alternative water heating devices which do not operate with such high energy loss rates (e.g., due to standby losses) are desirable.

An alternative type of water heater which does not suffer the above-described standby losses known as a tankless or a demand-type water heater (hereinafter simply referred to as a "tankless" water heater), is recently gaining in popularity in the United States. Specifically, as their name would indicate, tankless water heaters do not utilize water storage reservoirs. Instead, tankless water heaters sense or detect when hot water is being demanded by the building in which they are installed (e.g., by sensing a pressure drop in the hot water line), and then subsequently, simultaneously, activate a heating device and open a water flow valve in the water heater. Then, water travels through the passageways of the water heater, the heating device heats the water substantially instantaneously to a desired temperature and thereafter feeds the heated water to the plumbing of the building (e.g., household). Heating devices conventionally employed by tankless water heaters utilize electrical resistance or, alternatively, natural or propane gas-fired burners.

As a principle benefit of the design of tankless water heaters, such water heaters only heat water when there is an immediate demand for it and therefore do not employ or require a water storage reservoir. As a result, standby (heat) losses, such as those experienced by storage-tank-type water heaters, are substantially eliminated. Although, as can be seen, tankless water heaters present significant energy efficiency improvements over conventional tank-type water heaters, further improvements in tankless water heater efficiencies are desired. In an effort to address this desire for further improvements, significant efforts have been made in the industry to develop energy efficient water heaters powered by fuel cells. An exemplar listing of patents attempting such improvements is listed and described in brief detail below.

For example, the Yamamoto et al. reference (U.S. Pat. No. 6,420,060) discloses a solid polymer fuel cell water heater cogeneration system requiring the use of a fuel reformer to create hydrogen rich fuel gas. Such a system is impractical for residential use and would increase the size, complexity, and cost of the water heating system because hydrogen rich fuel gas is necessary for operation of the device (as well as for all known polymer fuel cells). Furthermore, the disclosed system requires the use of a storage tank for storing heated water and, therefore, experiences standby losses associated therewith.

In another example, the Hsu et al. reference (U.S. Pat. No. 6,054,229) discloses a system which integrates a fuel cell energy system with a Heating, Ventilation and Cooling (HVAC) system.

In still another example, the Crownden et al. reference (U.S. Pat. No. 6,645,652) discloses a fuel cell based electrical power generation system including a water circulation subsystem for circulating water within a fuel cell system and a water reservoir for collecting recycled water. The '652 reference further discloses a cogeneration heat exchanger associated with a temperature control subsystem for transferring thermal energy from the fuel cell system to a cogeneration system external to the fuel cell based electrical power generation system.

Although the above delineated references have in some instances, attempted to make improvements in cost or energy efficiency when compared to conventional storage tank-type and tankless water heaters, none of the references discussed, addressed or solved all of the drawbacks described above.

In view of the above-enumerated drawbacks, it is apparent that there exists a need in the art for apparatus and/or methods which solve and/or ameliorate at least one of the above problems of prior art water heaters. It is a purpose of this invention to fulfill these needs in the art as well as other needs which will become more apparent to the skilled artisan once given the following disclosure.

SUMMARY OF THE INVENTION

Generally speaking, this invention fulfills the above-described needs in the art by providing: a tankless water heater comprising:

- a cold water inlet for receipt of water to be selectively heated by the water heater;
- a hot water outlet in fluid communication with the cold water inlet for discharge of hot water heated by the water heater;
- a water passageway connecting the cold water inlet to the hot water outlet;
- a fuel cell;
- a fuel inlet for receipt of a fuel;
- an oxidant inlet for receipt of an oxidant gas;
- an exhaust outlet for exhaust of effluent gases a heating mechanism located in temperature conductive communication with the water passageway, the heating mechanism being electrically connected to the fuel cell such that the fuel cell is capable of providing electrical current to the heating mechanism for selectively heating water flowed into the cold water inlet for discharge by the hot water outlet;
- wherein the oxidant inlet and the exhaust outlet are so configured and located, one with respect to the other, such that, during water heater operation, effluent gases which exit the water heater are capable of heating oxidant gases entering the water heater.

It is an object of one embodiment of the subject invention to provide a water heater which is energy efficient and which produces a minimal amount of toxic or pollutant byproducts.

In at least one embodiment of the invention, it is an object to provide a fuel cell powered water heater which is capable of relaying excess power generated by the fuel cell to the public electrical grid and/or to the private electrical system of a household. In related embodiments, a battery charger and battery are employed so that excess electrical power can be stored for emergency usage needs.

In another embodiment of the invention, it is an object to provide a fuel cell powered water heater in which the fuel cell can be selectively operated as an electrolyzer.

BRIEF DESCRIPTION OF THE DRAWINGS

FIG. 7 illustrates a plan view of one example of a fuel cell powered water heater according to an embodiment of the subject invention which employs a gas fueled burner.

FIG. 8 illustrates an overhead, cross-sectional view of the embodiment of the water heater depicted in FIG. 7.

DETAILED DESCRIPTION OF CERTAIN EMBODIMENTS

Definitions: The term "fluid" as is used herein in the specification and claims is intended to retain its accepted art and/or scientific definition. In this regard, the term "fluid" includes gases within its scope and, therefore, a component described as being in fluid communication, is, in some circumstances, in gas-flow communication.

For a more complete understanding of the present invention and advantages thereof, reference is now made to the following description of various illustrative and non-limiting embodiments thereof taken in conjunction with the accompanying drawings in which like reference numbers indicate like features.

Figure 1:
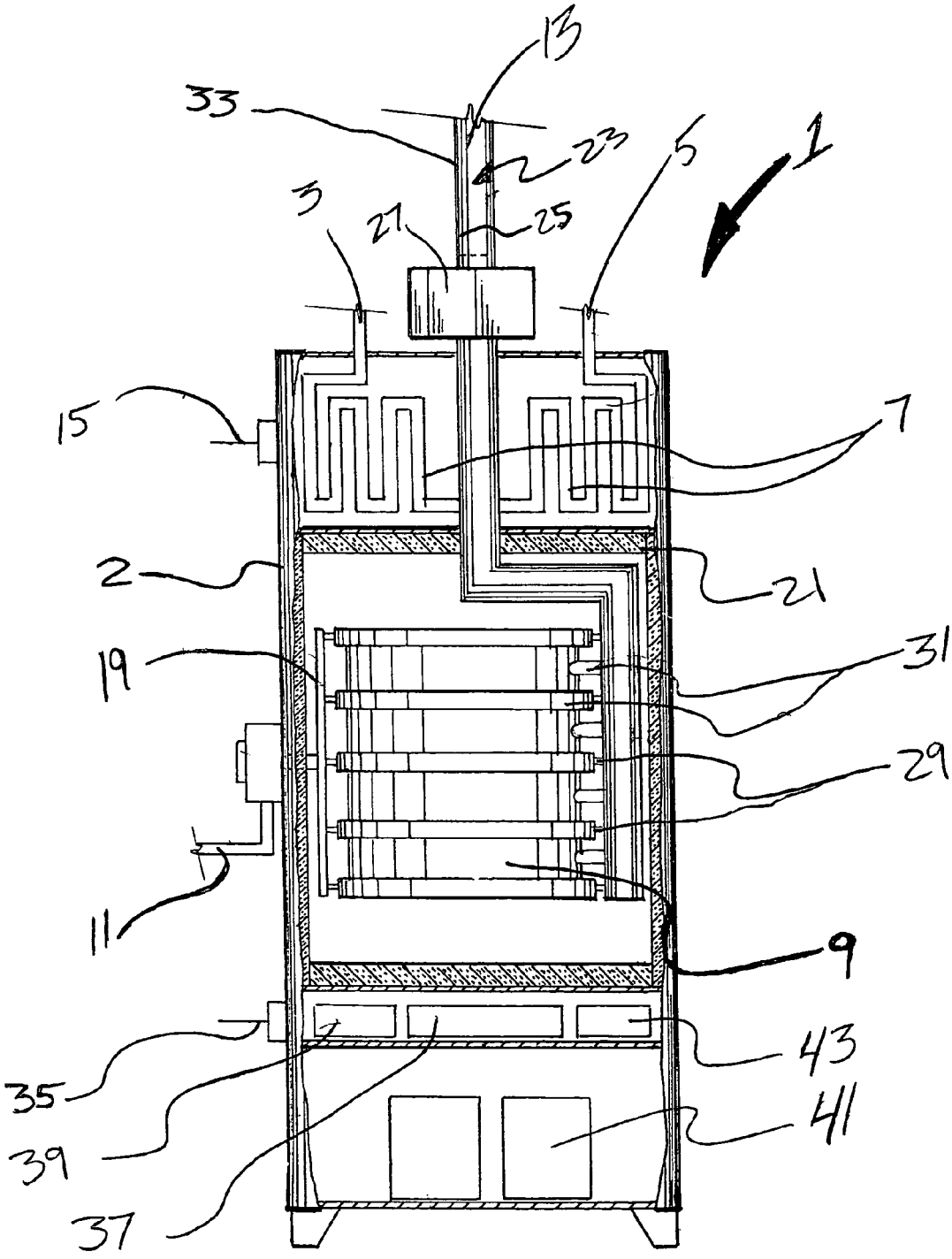
FIG. 1 illustrates a plan view of one example of a fuel cell powered water heater according to one embodiment of the subject invention.

Referring initially to FIG. 1, an exemplar water heater 1 according to one embodiment of the subject invention is illustrated therein. As can be seen in the figures, water heater 1 is of the tankless variety and therefore does not utilize a water storage reservoir, i.e., principally because it heats water "on demand". Generally speaking, then, in terms of basic functionality, water heater 1 water includes a cold water inlet 3 for input of cold water, a water heating mechanism 7 for heating cold water which enters the cold water inlet, and a hot water outlet 5 for outputting hot water, heated by heating mechanism 7, to the hot water supply side of the plumbing system of the building in which the water heater is installed. Importantly, because water heater 1 is a demand-type water heater, water is only heated when hot water is being "requested" by the household (or other type building) in which the heater is installed and, therefore, there is no need for a water storage tank or reservoir (because heated water is immediately output to the hot water supply side of the plumbing system).

As a more specific example of the manner in which the preferred embodiment of the invention illustrated in FIG. 1 operates, water heater 1 includes an operation control system, embodied by computer 39, which is communicably connected to various sensors (not shown) for detecting various operational conditions of the water heater. As certain operational conditions are detected, they are interpreted and processed by encoded operational software which, in turn, generates operational instructions to control the operation of the water heater.

For example, when water heater 1 is installed in a residential household building and a hot water faucet is opened or turned on, a pressure drop in the hot water pipe is created which is detected by a pressure sensor in the water heater (not shown) and then transmitted to computer 39. Upon detecting such a pressure drop, computer 39 generates a signal to open a cold water valve (not shown) so that cold water begins flow into cold water inlet 3. Substantially simultaneously, heating mechanism 7 (e.g., an electrical resistance heating element or a gas fueled heating mechanism) is activated and the cold water coursing through water heater 1 is heated and then supplied to the plumbing of the household via hot water outlet 5. Once the hot water user has received a desired volume of hot water for household use and the user, for example, turns off a hot water faucet or a hot water using appliance is shut down, a pressure increase in the hot water pipe is generated and detected (e.g., by a pressure sensor in the system), and then computer 39 initiates the closure of the cold water valve while simultaneously deactivating heating mechanism 7.

During use of water heater 1, electrical power for the operation of computer 39 as well as for the operation of the various additional sub-components of water heater 1 is provided by one or more sources depending on a variety of operational conditions. In this regard, in the example embodiment illustrated in FIG. 1, an electrical inlet 15 is included which is normally connected to the household electrical system (e.g., a 220–240 volt alternating current system). Moreover, exemplar water heater 1 includes a fuel cell 9 located within water heater housing 2 for generating electrical power internally as well as a power storage device, i.e., storage system or battery 41 for storing electrical power within the water heater body.

In a typical example operation, then, in an embodiment which employs an electrical resistance-type heating element, heating mechanism 7 is heated by the resistance of electrical current flowing through the heating mechanism, such electrical current being generated by fuel cell 9. In such an embodiment, it is noted that in order to initiate operation of fuel cell 9, which, in this preferred embodiment, is a solid-oxide fuel cell, the cathode (of fuel cell 9) and the oxidant gas it reacts with must first be heated to a temperature of approximately 600C–800C. At this temperature, fuel cell 9 produces electricity through performance of certain known chemical reactions which produce electron flow. Such reactions are described in detail in *A Direct-Methane Fuel Cell with a Ceria Based Anode*, E. Perry Murray et al., Nature, Vol. 400, pg. 649, Aug. 12, 1999, the entirety of which is hereby incorporated by reference. In order to bring the cathode and oxidant gas to operating temperatures in this preferred embodiment of the invention, when operation of fuel cell 7 is first initiated, computer control system 39 activates a heating element (not shown, but located on the cathode side of the fuel cell) in order to heat the cathode and oxidant gas (which will then react therein). Electricity for operating the cathode heating element can be provided via electrical inlet 15 (i.e., provided by the public electrical grid), or, alternatively, by storage system 41 (e.g., an electrical DC storage system composed of batteries and ultra capacitors routed via a relay circuit) depending on environmental circumstances, for example.

As an alternative to employing an electrical resistance heating element for heating water in, at least, one embodiment, gas burners are used. In such an embodiment, such as illustrated in FIGS. 7 and 8, gas fueled burner 8 is utilized in place of heating mechanism 7. In this embodiment, exhaust pipes 10 are used for removal of burner waste gases. Moreover, an additional gas fuel inlet 11 is used for fueling the burner.

In one particularly preferred example of the subject invention, computer control system 39 is programmed to relay power for fuel cell activation from the electrical grid (e.g., the household or public grid system) when it is detected that the electrical grid is operational. However, if the electrical grid is determined to be non-functional (e.g., during a "black out" or "brown out"), computer 39 relays stored power from storage system 41 for use by the cathode heating element. In the described embodiment, such a sequence is chosen in particular so that, for example, DC power stored in storage system 41 can be used in case of emergency power needs. In still other example embodiments, use of a bi-functional solid oxide fuel cell system is contemplated. In particular, such a system would be capable of functioning as a fuel cell (i.e., creating electric power) while simultaneously (or, in the alternative) electrolyzing water or carbon dioxide to create hydrogen fuel or carbon monoxide fuel to be stored for later use. Other modes or sequences of operation are, of course, contemplated.

An additional feature that computer 39 provides, in some embodiments, is the ability to provide operational data to a user. In this regard, some embodiments of water heater 1 utilize a computer (with associated software) which can be programmed to automatically report the operational status of the water heater, the amount of power or fuel usage, and/or the charge state of the batteries (i.e. storage system 41), for example. Moreover, in such embodiments, computer 39 can be configured so that operational or use data can be transmitted to remote locations, such as via an email messaging type system or by transmission of wireless messages, for example.

Turning now back to the operation of water heater 1, as the cathode side of fuel cell 9 is provided with an oxidant gas (e.g., atmospheric air from out side the building), fuel is simultaneously provided to the anode side of the fuel cell via fuel inlet 11 (e.g., which is connected to a household natural gas supply line or propane fuel tank, or, alternatively, a hydrogen or carbon monoxide source or any other appropriate fuel source). In this manner, the heretofore known electricity generating solid oxide fuel cell reactions can take place.

As the flow of electrical current is initiated from fuel cell 9, the resulting electrical current can be relayed according to demand and for a variety of uses including heating cold water input into the water heater (via inlet 3), as well as for providing electrical current to the household or the public electrical grid (via outlet 35), or the current can be simply directed to storage system 41 for storage for later use. Thus, in typical operation, for example, if computer control system 39 has detected a demand for hot water (e.g., in typical operation via a pressure sensor), electricity will be routed by the computer (via control of relays) to heating mechanism 7. Alternatively, if a power outage has been detected, electrical current can be directed to the household for use thereby (and withheld from the public grid because of the potential danger to the electrical linemen who are working to restore the public grid to functional operation), for example. While each of the above routing or relaying options are stated herein as occurring independently from one another, it is additionally contemplated that such power routing options can occur simultaneously with one or more of the others. For example, while hot water is being produced using electrical power from fuel cell 9, excess current produced by fuel cell 9 can be directed for storage to storage system 41.

In still other embodiments employing bi-functional fuel cells, as briefly discussed above, electrical current can be used to electrolyze compounds to create fuel for storage. Electrical current, in such embodiments, can be sourced from fuel cell 9, from the public grid, or from storage system 41.

Figure 2:
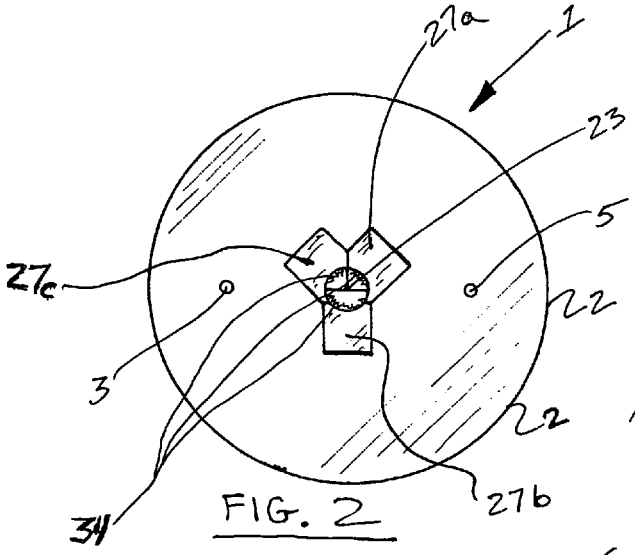
FIG. 2 illustrates an overhead, cross-sectional view of a fuel cell powered water heater according to an alternative embodiment of the subject invention.

As described above, it is known in the operation of solid oxide fuel cells that the cathode and the oxidant gas which reacts therewithin must be heated in order for the oxide releasing reactions to occur (at least at a rate which will be sufficient to produce a reasonably usable amount of electrical current). In knowledge thereof, Applicant for the instant invention has conceived of an exhaust system for at least one preferred embodiment of water heater 1 in which exhaust gases being expelled by the water heater are used to simultaneously heat incoming oxidant gases. Referring now to FIGS. 1 and 2, examples of two embodiments of such an exhaust system are illustrated therein. As can be seen in the embodiments as illustrated, an exemplar flue pipe 23 is comprised of three chambers, two of which are used for flow of outgoing exhaust-type gases (e.g., fuel exhaust and oxidant exhaust gases) and one of which is used for inflow of oxidant gas (for supply to the cathode of fuel cell 9). More specifically, flue pipe 23 in the embodiment illustrated in FIG. 1, is comprised of three nested tubular members including oxidant inlet pipe 13, fuel exhaust pipe 25, and oxidant exhaust pipe 33, each defining a gas passageway. As can be seen most clearly in FIG. 1, each pipe 13, 25, and 33 nests or is nested within another pipe (13, 25, or 33) and is oriented substantially in-line or parallel to the others. In this manner, as heated exhaust gases exit water heater 1 via pipes 25 and/or 33, their proximity to pipe 13 causes a heat exchange to occur (i.e., a conductive heat exchange through the metallic pipe surfaces) and oxidant gases entering water heater 1 are therefore pre-heated prior to entry into the cathode. As a result, more efficient oxide formation and release occurs in the cathode and better fuel cell performance is achieved. In order to promote an efficient rate of heat exchange between the chambers, i.e., to promote rapid heating of oxidant gases, in preferred embodiments oxidant inlet pipe 13 is located at the center of the flue pipe assembly.

In an alternative embodiment of the exhaust assembly, illustrated in FIG. 2, flue pipe 23 comprises three interconnected pipes connected in a pie-type configuration. More particularly, in this embodiment, rather than nesting pipes 13, 25 and 33, one within the others the pipes are complementary configured and connected along their longitudinal lengths. In this manner, once again, heat exchange between pipes 13, 25 and 33 occurs during operation, resulting in the preheating of oxidant gases.

Although many termination configurations of pipes 13, 25, and 33 can be envisioned, in preferred embodiments, as FIG. 1 illustrates, fuel exhaust pipe 25 terminates within water heater 1 at fuel exhaust manifold 29 and oxidant exhaust pipe 33 terminates at oxidant exhaust manifold 31. Each manifold 29 and 31, in turn, is fluidly connected to fuel cell 9's anode and cathode respectively. Moreover, oxidant inlet pipe 13 is in fluid communication with oxidant intake manifold 21 (which, in turn, is fluidly connected to the cathode). Additionally, exhaust blower 27 is connected located in-line with flue pipe 23. When operated as desired or as initiated by computer control system 39, exhaust blower 2 is capable of actively and efficiently flowing fuel and oxidant exhaust gases from water heater 1 (i.e., manifolds 10 and 12) to the atmosphere via flue pipe 23. In alternative embodiments, such as disclosed in FIG. 2, each chamber of flue pipe 23 utilizes its own blower or fan 27*a*, 27*b* and 27*c*. In such embodiments, oxidant gas inflow volume substantially improved as is the efficiency of exhausting waste gases. In still other embodiments, alone or in combination with the various features of the embodiments above, baffles 34 (or some other friction inducing mechanism) are employed in the respective interior surfaces of pipes 13, 25 and/or 33 in order to slow the rate of gas flow therein to improve the rate and/or volume of heat transfer (see FIG. 2).

In some embodiments, in order to simplify the installation of water heater 1 in a household, for example, the various water and gas (i.e., fuel) connectors of the water heater are preferably configured to connect to standard household water and gas fittings, respectively. Employing such standard fittings or connectors, no modifications to the plumbing or gas lines of a building will be required when installing water heater 1. Furthermore, no specialized skills or tools will be required for installation, and persons trained in conventional water heater installation will therefore have all necessary skills for installing this at least one embodiment of the present invention.

In still further preferred embodiments, flue pipe 23 can be connected to the existing exhaust flue typically found in a standard household using conventional techniques, for example (e.g., using sheet metal). It is contemplated, of course, however, that other methods or mechanisms of exhaust system installation (or configuration) may be similarly effective in practice.

Operation of known types of solid oxide fuel cells typically generates high volumes of heat producing temperatures sometimes in excess of 600–850 degrees Centigrade. Therefore, in order to maintain water heater 1 at desired levels of operation while, for example, simultaneously avoiding contributing to the load of an air-conditioning system of a building (particularly in the hot summer months or on other hot days), in some embodiments of the subject invention, such as illustrated in FIGS. 3–6, a cooling system is provided. When employing such a cooling system, excess heat generated by operation of the fuel cell can be exhausted to the exterior of the building (through a heat exchange process described in various examples below).

Figure 4:
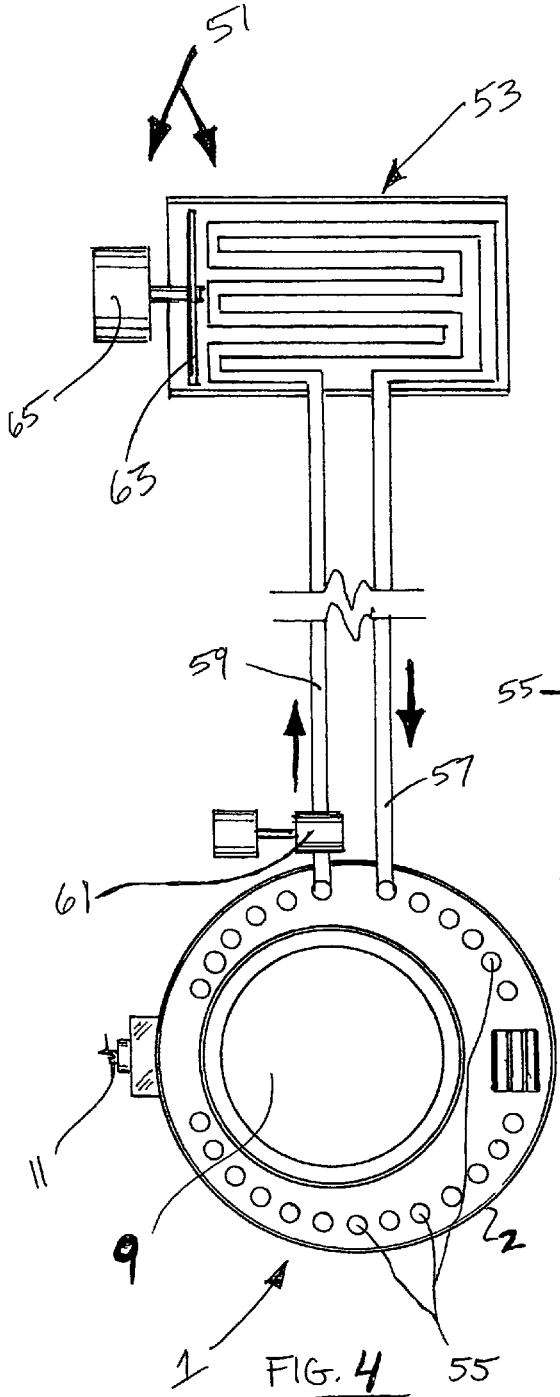
FIG. 4 illustrates an overhead, cross-sectional view of the embodiment of a water heater utilizing a liquid cooling system illustrated in FIG. 3.
Figure 3:
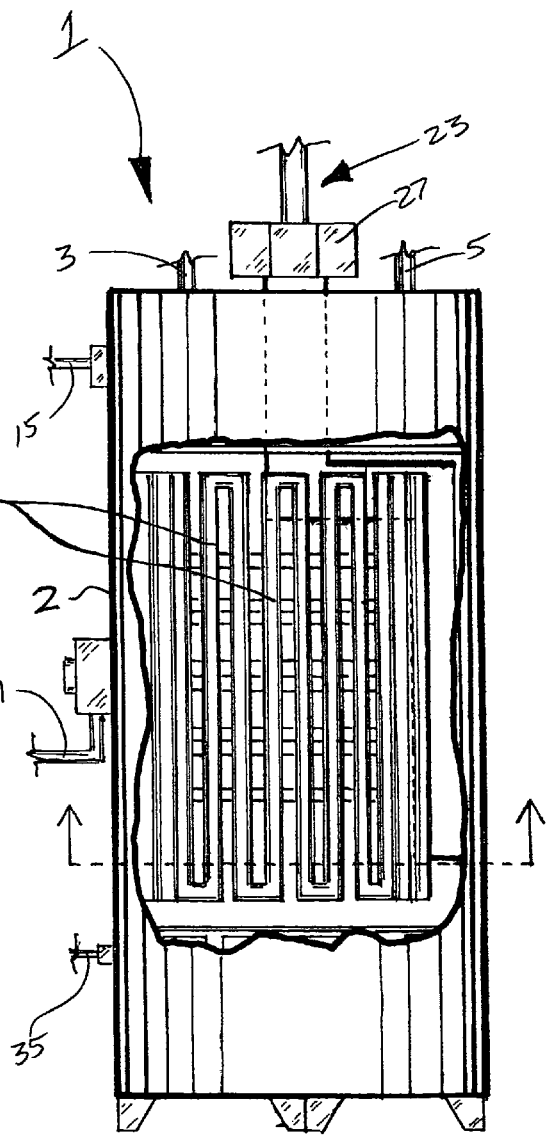
FIG. 3 illustrates a plan view of one example of a fuel cell powered water heater installed with a liquid cooling system according to one embodiment of the subject invention.

Focusing now specifically on FIGS. 3 and 4, an exemplar embodiment of a liquid cooling system 51 is illustrated therein. As illustrated, cooling system 51 functions principally by circulating a coolant fluid in the proximity of fuel cell 9 (or in contact with a surface or surfaces thereof) so that the coolant will absorb heat from the system and after which it is pumped to a radiator 53 (e.g., located outdoors or in some other suitable convenient location). More specifically, cooling system 51 includes a network of coolant tubes 55 which are located disposed about the exterior surfaces of fuel cell 9. Coolant tubes 55, in turn, are in fluid communication with radiator 53. Thus, during operation of water heater 1, pump 61 (e.g., connected to the coolant tubing) pumps coolant through the tube network thus causing a circulation of coolant fluid between the cooling tube network (surrounding the fuel cell) and the radiator. In this manner, coolant fluid which circulates about and around fuel cell 9 absorbs heat radiating therefrom and then is pumped to radiator 53 where cooling fan 63 (operated by motor 65) circulates a flow of air across the radiator tubing. As a result, the temperature of the coolant is substantially reduced in preparation for reentering the coolant tube network 55 surrounding the fuel cell. Using such a system, it is contemplated that the operating temperature of the water heater can be maintained at a safe level (while maintaining desired output levels) which is particularly important when the water heater is installed in a household, for example.

Figure 6:
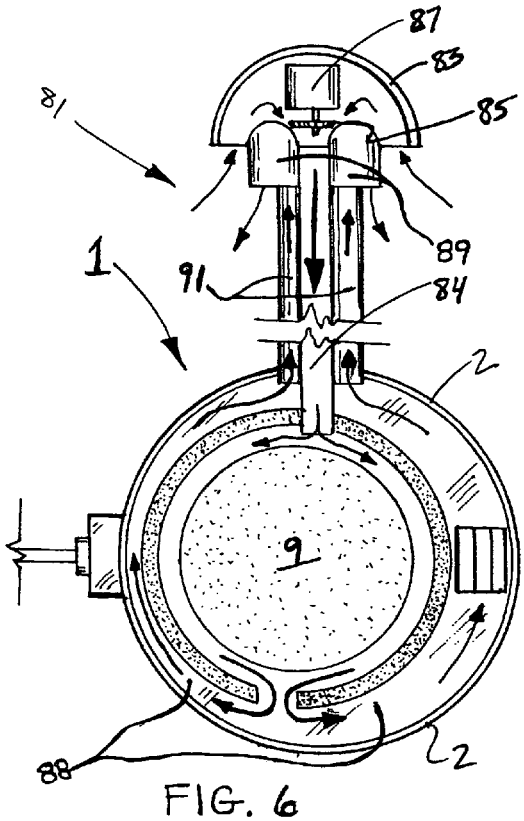
FIG. 6 illustrates an overhead, cross-sectional view of the embodiment of a water heater utilizing a liquid cooling system illustrated in FIG. 5.
Figure 5:
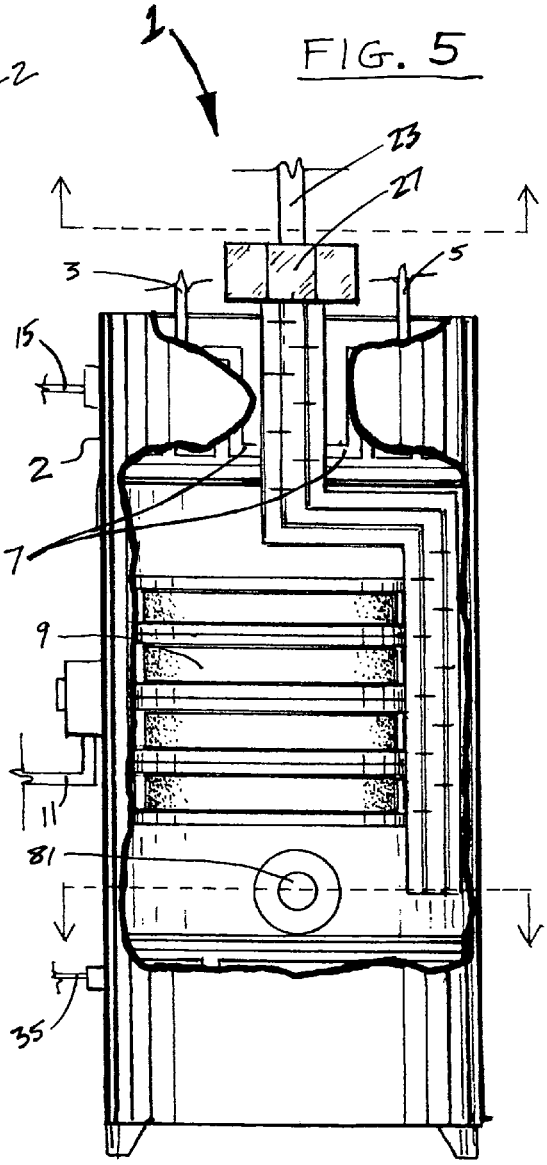
FIG. 5 illustrates a plan view of one example of a fuel cell powered water heater installed with an air cooling system according to one embodiment of the subject invention.

In an embodiment employing an alternative mechanism for cooling fuel cell 9, an air cooling system 81, as illustrated in FIGS. 5 and 6, is utilized. In such an embodiment, rather than using fluid to absorb heat produced by fuel cell 9 (i.e., in a heat exchange process), cool air is circulated around the fuel cell and then discharged from the water heater. As cool air is circulated around the perimeter of the fuel cell as such, the cool air absorbs ambient heat and then carries the heat outside of the water heater as it is discharged, for example, into the outdoor atmosphere.

Turning now to one embodiment of a specific configuration of cooling system 81, as can be seen in FIGS. 5 and 6, system 81 generally includes an intake duct 83 for inputting cold air into the water heater (e.g., from the outdoor atmosphere), and output ducts 89 for exhausting hot air. Connecting intake duct 83 and output ducts 89 is a series of air coolant passageways (indicated by arrows in FIG. 6) which, in preferred embodiments, circumnavigate fuel cell 9 along at least a portion of their length. Furthermore, in order to actively input air into the cooling system, an impeller 85, including a motor 87 for driving the impeller, is provided located at the opening of intake duct 83. During water heater 1's operation, then as fuel cell 9 is operated to heat water, impeller 85 can be selectively activated (e.g., it can be programmed to activate at a threshold temperature) in order to produce a positive influx of cold air into the cooling system. More specifically, as impeller 85 operates, air is drawn from the surrounding atmosphere and actively driven into intake passageway 84. Thereafter, the air circulates around the perimeter of fuel cell 9 (through passageways 88) and then is routed into output passageways 91 and finally expelled into the atmosphere via output ducts 89 (e.g., located in an outdoor area outside of the building in which the water heater is installed). In such manner, as the coolant air which is input travels through the coolant passageways, the air absorbs heat produced by the operation of fuel cell 9, and then transports such heat away from water heater 1 as the heated air is expelled from ducts 89.

Although the two examples of cooling systems described immediately above are believed to be effective options in some embodiments, use of either of these coolant-type systems is not required, nor is the use of any cooling system at all. In this regard, other techniques or devices for maintaining the safety and efficiency of water heater 1 (as it relates to operating temperature) may be employed without departing from the scope of the invention.

In a still further additional embodiment, as briefly discussed in relation to certain examples in various sections of the specification above, the utilization of a bi-functional fuel cell which serves the additional function of an electrolyzer is contemplated. In this regard, as it is generally know in the industry, the operation of a solid oxide fuel cell may, in effect, be reversed to create an electrolyzing system (e.g., to produce fuel for storage). When operating fuel cell 9 as an electrolyzing system as such, direct current in combination with the appropriate chemical compounds, such as water, can be fed to the anode side of the fuel cell-electrolyzer system. In the reactions which result, input water is electrolyzed to hydrogen while oxygen is driven to the cathode side of the fuel cell. Additionally, the system electrolyzes carbon dioxide to form carbon monoxide while driving oxygen to the cathode side of the system. After the electrolysis reactions take place, the resulting fuels can be removed from the anode side of the fuel cell for storage. Afterwards, or in some embodiments simultaneously with the removal of the resulting fuels, additional electrolyzer reactants can be fed to the anode side of the fuel cell to promote further electrolysis and, hence, further fuel production. Although certain specific electrolyzer reactants or compounds have been discussed herein, these examples are not intended to be limiting, and it is certainly anticipated that other electrolyzing compounds can be utilized in alternative embodiments of the system.

Once given the above disclosure, many other features, modifications, and improvements will become apparent to the skilled artisan. Such other features, modifications, and improvements are therefore considered to be part of this invention, the scope of which is to be determined by the following claims:

I claim:

1. A tankless water heater comprising:

a cold water inlet for receipt of water to be selectively heated by said water heater;

a hot water outlet in fluid communication with said cold water inlet for discharge of hot water heated by said water heater;

a water passageway connecting said cold water inlet to said hot water outlet;

a fuel cell;

a fuel inlet for receipt of a fuel;

an oxidant inlet for receipt of an oxidant gas;

an exhaust outlet for exhaust of effluent gases a heating mechanism located in temperature conductive communication with said water passageway, said heating mechanism being electrically connected to said fuel cell such that said fuel cell is capable of providing electrical current to said heating mechanism for selectively heating water flowed into said cold water inlet for discharge by said hot water outlet;

wherein said oxidant inlet and said exhaust outlet are so configured and located, one with respect to the other, such that, during water heater operation, effluent gases which exit said water heater are capable of heating oxidant gases entering said water heater.

2. A tankless water heater according to claim 1 further including a first electrical supply connection connecting said fuel cell to a private electrical system; and a second electrical supply connection connecting said fuel cell to a public electrical grid.

3. A tankless water heater according to claim 2 further including a power storage device electrically connected to said fuel cell, said power storage device being capable of storing power and thereafter supplying said stored power selectively for emergency power needs.

4. A tankless water heater according to claim 2 wherein said heating mechanism comprises a heating element which heats water via electrical resistance as electrical current is conducted through said heating element.

5. A tankless water heater according to claim 4 wherein said fuel cell is capable of selectively providing power to a private electrical system and is capable of selectively providing power to a public electrical grid.

6. A tankless water heater according to claim 5 further including a water heater control module, said water heater control module being capable of detecting select operational conditions and selectively routing electrical output of said fuel cell according to instructions corresponding to detected operational conditions.

7. A tankless water heater according to claim 6 wherein said control module is capable of detecting at least one operational condition selected from the group consisting of:

water heating needs, power outages, public electrical grid power needs, private electrical grid power needs, and power storage device capacity levels.

8. A tankless water heater according to claim 5 further including an inverter electrically connected to said fuel cell for converting direct current to alternating current and for directing said alternating current to an electrical pathway for providing said alternating current to an end use selected from the group consisting of:

a public electric grid, a private electric grid, and a power storage device.

9. A tankless water heater according to claim 3 further including a flue, said flue comprising three passageways including:

a first passageway for exhaustion of fuel exhaust;

a second passageway for exhaustion of oxidant exhaust; and a third passageway for induction of oxidant gas to said fuel cell.

10. A tankless water heater according to claim 9 wherein said flue comprises first, second, and third chambers, said first chamber encompassing said first passageway, said second chamber encompassing said second passageway, and said third chamber encompassing said third passageway; and wherein said first, second, and third chambers are in temperature conductive contact with one another thereby to permit heat exchange between gases located in said chambers.

11. A tankless water heater according to claim 10 wherein said first, second, and third passageways are oriented substantially parallel one to the other thereby to permit heat exchange between gases flowing through said passageways.

12. A tankless water heater according to claim 11 further including a blower device located in fluid communication with at least one chamber of said flue thereby to promote ingress or egress of gas to or from said water heater.

13. A tankless water heater according to claim 12 wherein said blower device is in fluid communication with at least one chamber of said flue selected from the group consisting of: said first chamber and said second chamber;

said blower device being in fluid communication with said at least one chamber thereby to assist in exhaustion of exhaust gas from said water heater.

14. A tankless water heater according to claim 13 wherein said blower device is in fluid communication with at least said third chamber of said flue;

said blower device being in fluid communication with said at least said third chamber thereby to create a positive flow of oxidant gas into said water heater selectively during operation.

15. A tankless water heater according to claim 14 further including a fuel source connected to said fuel inlet, said fuel source selected from the group consisting of:

natural gas, propane gas, and hydrogen gas.

16. A tankless water heater according to claim 15, wherein said fuel cell is a solid oxide fuel cell.

17. A tankless water heater according to claim 16, wherein the fuel cell acts as an electrolyzer for separating hydrogen from water and separating carbon monoxide from carbon dioxide.

18. A tankless water heater according to claim 17 further including a control module, said control module being capable of detecting a request for hot water, and being capable of starting and stopping operation of said water heater to begin or cease hot water flow as requested.

19. A tankless water heater according to claim 18 further including a cooling system for cooling at least one component of said water heater during operation, said cooling system being selected from the group consisting of:

an air cooling apparatus; and a liquid cooling apparatus.

20. A tankless water heater according to claim 16 wherein said fuel inlet includes a standardized connector for connecting to a standardized household fuel supply connector; and wherein said cold water inlet and said hot water outlet include standardized plumbing connectors for connecting to standardized household plumbing lines.

21. A tankless water heater according to claim 1 wherein said fuel cell is bi-functional and, as such, is capable of being operated as an electrolyzer for producing fuel.

22. A tankless water heater according to claim 21 wherein when said fuel cell is operated as an electrolyzer, direct current and water as an electrolyzer reactant are fed to an anode side of said fuel cell, and wherein thereafter said water is electrolyzed to produce hydrogen fuel and oxygen is driven to the cathode side of the fuel cell; and wherein said hydrogen fuel is directed to a storage vessel.

23. A tankless water heater according to claim 7 wherein said control module is communicably connected to a remotely located monitoring system for monitoring operational conditions of said water heater.

24. A tankless water heater according to claim 23 wherein said remotely located monitoring system is internet based and is capable of automatically, periodically polling real time operational data from said control module and is capable of reporting said operational data to a data base.

* * * * *